United States Patent [19]

Gehman et al.

[11] Patent Number: 4,672,365

[45] Date of Patent: Jun. 9, 1987

[54] SECURITY SYSTEM WITH DIGITAL DATA FILTERING

[75] Inventors: Stacy E. Gehman; Kevin T. Ruddell, both of Seattle, Wash.

[73] Assignee: Emhart Industries, Inc., Indianapolis, Ind.

[21] Appl. No.: 871,483

[22] Filed: Jun. 6, 1986

[51] Int. Cl.[4] ..... G08B 1/08

[52] U.S. Cl. ..... 340/539; 340/531; 455/63; 375/26

[58] Field of Search ..... 340/539, 531, 534, 345; 455/63; 375/26, 99

[56] References Cited

U.S. PATENT DOCUMENTS

| | | | |
|---|---|---|---|
| 4,020,477 | 4/1977 | Holland | 340/539 |
| 4,095,211 | 6/1978 | Shaughnessy | 340/539 |
| 4,153,881 | 5/1979 | Permut et al. | 340/539 |
| 4,511,887 | 4/1985 | Fiore | 340/539 |
| 4,604,607 | 8/1986 | Sanderford, Jr. et al. | 340/539 |

*Primary Examiner*—Donnie L. Crosland
*Attorney, Agent, or Firm*—Robert F. Meyer; Carl A. Forest

[57] ABSTRACT

A security system having one or more sending units for transmitting a digitized r-f signal representative of a condition such as fire, smoke, intrusion, battery condition, an emergency, or other condition to a central receiving unit. The sending units include a microcomputer which Manchester encodes the data. The receiving unit includes a microprocessor which samples the data signal 24 times per data bit. The moving average of the 12 most current samples is calculated and differentiated into a high or low value depending on the value of the previously calculated averaged value. The time between data transitions (from high to low or low to high) is evaluated and then stored as being a long (1) or a short (0) time since the previous transition. When all the data has been received, the stored values for length of time between transitions are checked for conformance to the transition timing requirements of Manchester encoded signals. Signals without the proper timing are discarded. Signals that conform to the proper timing requirements and which contain a valid cyclic redundancy code and transmitter identification code are gated to an output device to provide an indication of the condition.

14 Claims, 10 Drawing Figures

SIGNAL
DATA SAMPLE
RF SUM A
RF SUM B
RF SUM C
RF SUM BIG
RF FILT RF
ADD RF FILT RF TO RF SUM BIG
RF FILT
CHANGE IN LEVEL
RF SAME CTR
STORED VALUE (LONG-1/SHORT-0)
NO
YES
NO
YES
NO
YES

SECURITY SYSTEM WITH DIGITAL DATA FILTERING

BACKGROUND OF THE INVENTION

1. Field of the Invention.

The invention in general relates to security systems and in particular a wireless security system having one more detector/sending units for reporting the existence of a condition to a central receiving unit.

2. Description of the Prior Art

Security systems which include one or more sending units which transmit coded radio frequency (r-f) signals to a central receiving unit which decodes the signals to produce an alarm or other indication of a condition at the sending unit location are well known. The condition may be the existence of a fire, an intrusion, an emergency, the presence of water or other fluid, or other condition desired to be monitored. Or the condition may be the status of the sending unit, such as the condition of its battery or other sensor status. The term "security system" as used herein is intended to include any such system that sounds an alarm or reports on one or more of the above conditions. Generally, the information sent will also include the identity or location of the sending unit. A major problem with r-f or wireless security systems is the lack of reliability of the communicated data. The information or the condition, status, location etc. is generally transmitted serially as a string of digital data bits modulated on the r-f carrier wave which is received and demodulated by the central receiving unit to provide a digital data string to a processing circuit which analyzes the data. Because of the nature of r-f communication, noise can disturb this process by causing unwanted transitions in otherwise valid transmitted data or by generating apparent data that is actually only noise. Since the processing circuitry analyzes the received data for information about the status of the various sensors, noise in the data can cause a system to either reject a valid transmission or to falsely report an alarm status for one of the sensors. Previous attempts to solve this problem have involved transmitting the data several times and requiring the processing circuitry to receive multiple, identical data strings before reporting an alarm condition. This results in inefficient use of transmission time, leading to problems with battery life, clash (or collision) of transmissions from different sending units and meeting FCC regulations on net broadcast energy. This invention discloses a new approach for solving the noise problem in security systems involving filtering the received signals to remove the noise and analysis of the signals to reject signals which are too noisy to be filtered.

SUMMARY OF THE INVENTION

It is an object of the invention to provide security apparatus and methods that permit the restoring of noise-corrupted data.

It is another object of the invention to provide security apparatus and methods that permit the received signal to be reliably checked for accuracy more simply and efficiently than with the repetition of a data signal.

It is another object of the invention to provide security apparatus and methods that provide one or more of the above advantages with a system that transmits a Manchester encoded signal and checks the received signal for conformance to the timing requirements of Manchester encoded signals.

It is a further object of the invention to provide a security system and method which samples each received data bit a plurality of times and averages the sampled data to filter out the noise.

The invention provides a security system comprising: sensing means for sensing a condition; transmitter means responsive to the sensing means for transmitting a digital signal representative of the condition; receiving means for receiving the digital signal; sampling means for sampling the received digital signal a plurality of times during each digital data bit and for producing a plurality of data samples for each received data bit; means for storing a value related to an average of the data samples; averaging means communicating with the means for storing for averaging the plurality of data samples together with a value related to a previous set of data samples to provide an averaged data signal with hysteresis; and output means responsive to the averaged data signal for producing an output indicative of the condition. Preferably, the output means includes a checking means for checking the data signal for conformance to a predetermined arrangement. Preferably, the transmitter means includes a means for Manchester encoding the digital signal and the checking means comprises a means for checking that the data signal conforms to the transition timing requirements for Manchester encoded signals. Preferably the averaging means comprises a means for calculating a moving average of the data samples and a means for differentiating the average into a high or low signal depending on the value related to a previous set of data samples.

The invention also provides a method of providing an indication of a condition at a location in a security area comprising the steps of: sensing the condition and providing a data signal representative of the condition; transmitting the data signal; receiving the data signal, sampling the received data signal a plurality of times during each data bit, averaging the data samples together with a value related to a previous set of data samples to produce an averaged data value with hysteresis; storing a value related to the averaged data value for use in the calculation of a subsequent average; and utilizing the averaged data to provide an indication of the condition. Preferably the step of utilizing the averaged data includes the step of checking the data for conformance to a predetermined arrangement.

The apparatus and method of the invention permit the restoration of data with up to 30% noise in an individual bit. It also provides several levels of protection to prevent noisy data from being interpreted erroneously. Numerous other features, objects and advantages of the invention will become apparent from the following detailed description when read in conjunction with the accompanying drawings.

DESCRIPTION OF THE PREFERRED EMBODIMENT

Figure 1:
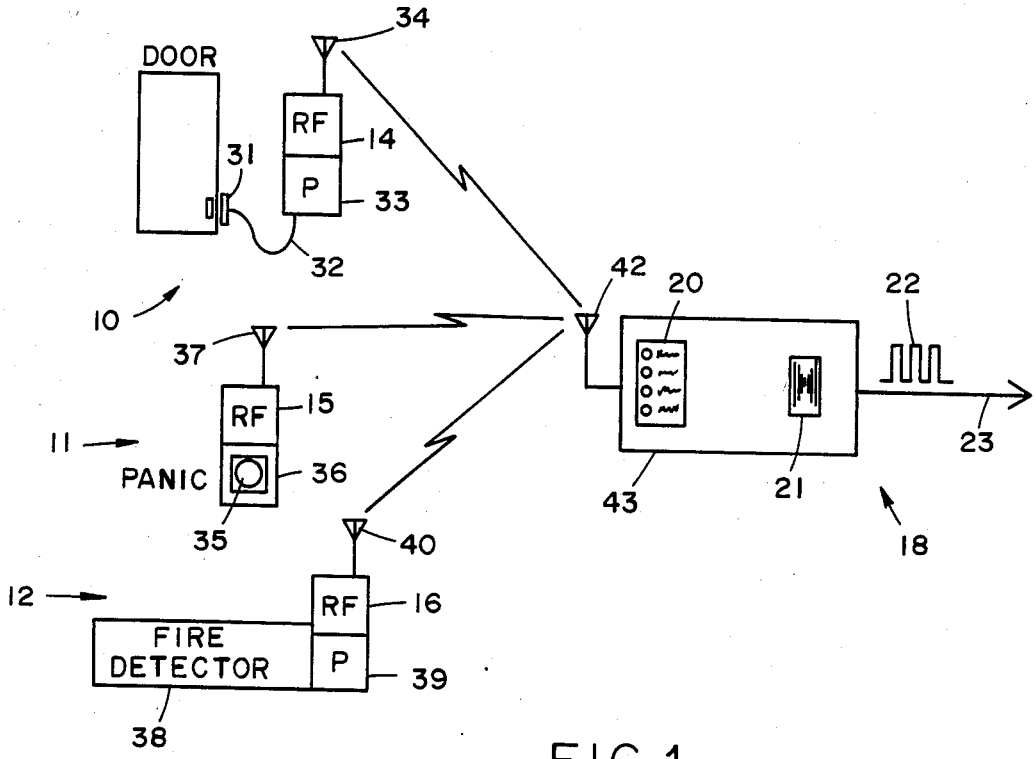
FIG. 1 is a schematic illustration of an exemplary security system according to the invention.

Directing attention of FIG. 1, an exemplary embodiment of the security system according to the invention is shown. This embodiment includes three remote sending units 10, 11 and 12 and a central receiving unit 18. The sending units include an intrusion detector 10 on a door, a panic button unit 11, and fire detector unit 12, each of which produces a signal when the particular condition they are designed to detect occurs. Each remote detector unit 10, 11 and 12 has a radio frequency (r-f) transmitter 14, 15 and 16 respectively, associated with it which transmits a Manchester encoded modulated r-f signal which is received by the central unit 18. The r-f signal preferably comprises an 8-bit preamble, an 8-bit system identifier, a 6-bit transmitter identifier, 4 status bits, a 5-bit cyclic redundancy check, and a 2-bit end of transmission marker (EOT). The purpose of the preamble is to provide time for the receiver to adjust to the incoming signal and to generate a carrier detect signal. The preamble need not be Manchester encoded, and is usually arranged to optimize the receiver's response time. The EOT is also not Manchester encoded, but consists of 2-bit times of a constant level equal to the true value of the last data bit. The central unit 18 demodulates the signals, filters them, analyzes and checks them to be sure they conform to the Manchester timing requirements and include a proper cyclic redundancy code and the identifiers, then decodes the signals which pass the checks and provides outputs, such as flashing lights 20, a buzzer 21, or a signal 22 over a telephone line 23 to a supervising station (not shown), which indicate the conditions detected.

Turning now to a more detailed description of the invention, the preferred embodiment of the detection system shown in FIG. 1 includes an intrusion detector unit 10, a panic button unit 11 and a fire detector unit 12. It is understood that the three remote units shown are exemplary. An embodiment may have two such remote units or it may have hundreds. Other types of detectors than intrusion, panic and fire may also be included. For example, detectors which signal the presence of water where it should not be, or other unsafe or undesirable conditions may be included. Or the system may include only one type of detector, such as a fire alarm. Remote unit 10 includes a magnetic contact device 31 on a door which is connected via wire 32 to a signal processing circuit 33. The processing circuit 33 is connected to r-f transmitter 14 which transmits a signal to central unit 18 via antenna 34. Similarly, panic unit 11 comprises a panic button 35 which is connected to signal processing circuit 36, which is connected to transmitter 15, having antenna 37, and fire unit 12 comprises fire detector 38 which is connected to signal processor 39, which is connected to transmitter 16, having antenna 40. Central unit 18 includes antenna 42 which is connected to a receiver 88 (FIG. 3) and signal processing circuitry within the chassis 43 of central unit 18. The signal processing circuitry is connected to annunciator lights 20, buzzer 21, and a telephone line 23. Other inputs and outputs shall be discussed in reference to FIG. 3. It should be understood that the inputs and outputs are exemplary. In some embodiments, a variety of others may be used. It is also understood that a wide variety of other signals, such as battery status signals, supervision signals, etc. may be transmitted between remote units 10, 11 and 12 and central unit 18.

Figure 2:
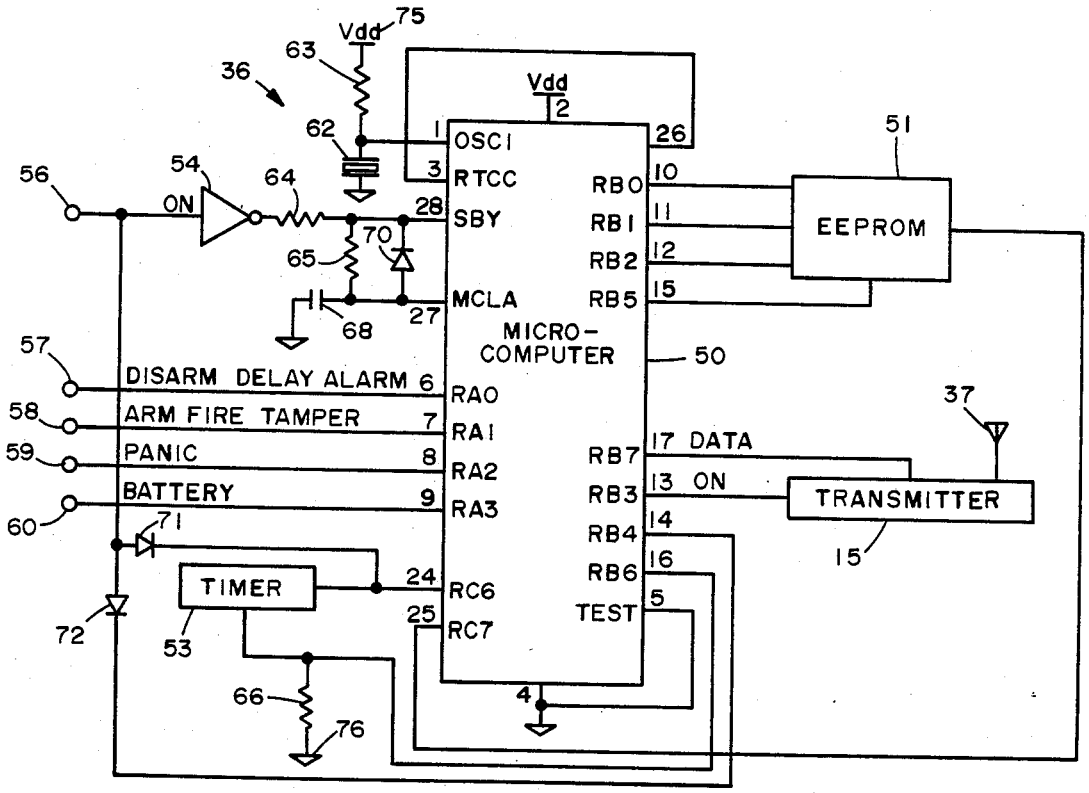
FIG. 2 is an electrical circuit diagram of a portion of a sending unit according to the invention showing the electrical connections to the microcomputer.
Figure 3:
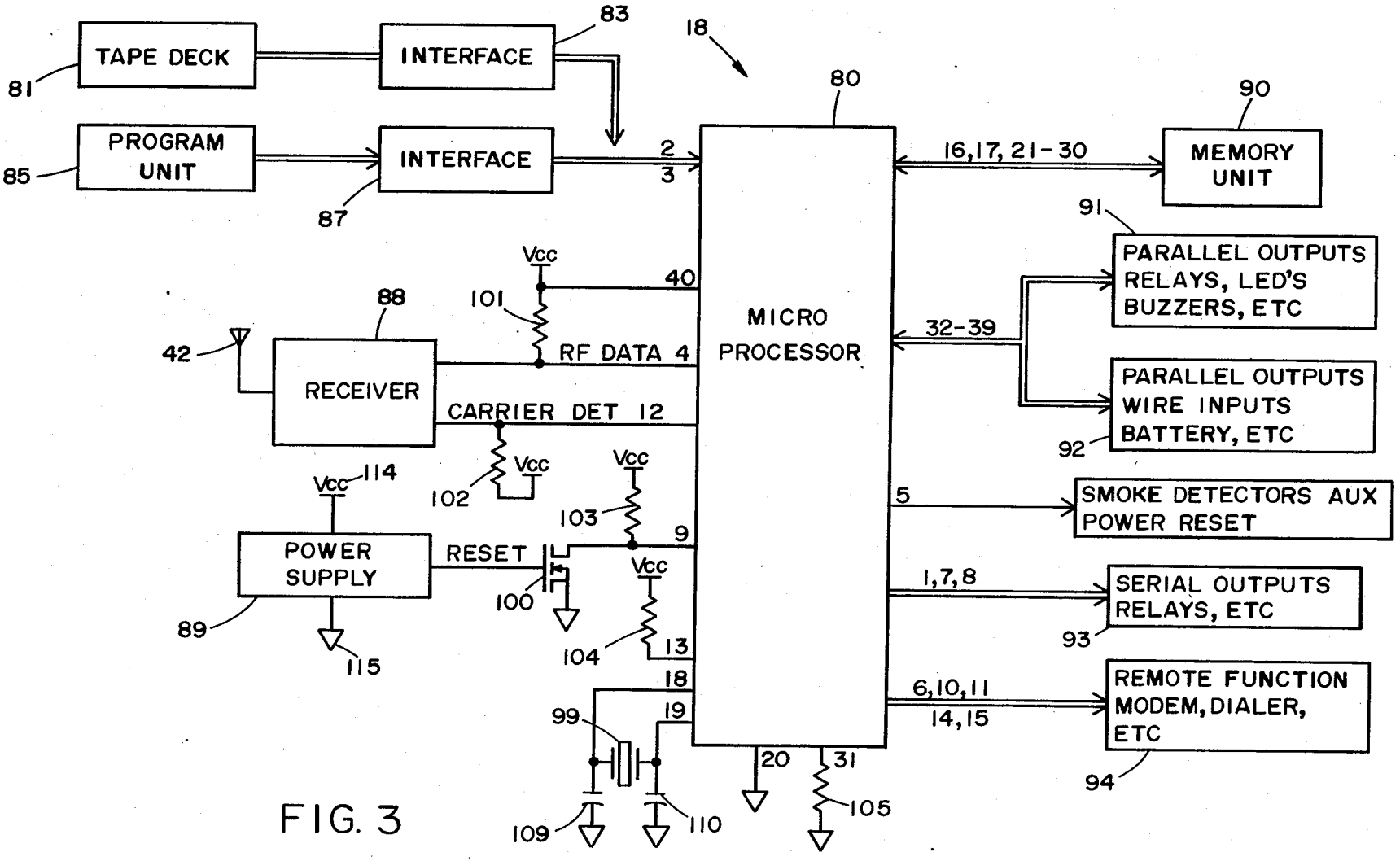
FIG. 3 is an electrical circuit diagram of the receiving unit of the invention showing the connections to the microprocessor.

A semi-block diagram of the circuitry of a processing circuit, such as 36 of an exemplary sending unit, such as 11, is shown in FIG. 2, and a semi-block diagram of the circuitry of the central receiving unit 18 is shown in FIG. 3. In these drawings, the numbers on the lines into the microcomputer 50 and the microprocessor 80, such as the "1" at the upper-left of the microcomputer 50, refer to the pin numbers of these two components. The labels within the microcomputer and microprocessor next to the pins, such as "OSC1" next to pin 1, refer to the internal signals of these computing units. The pin numbers and other details of the other components, such as EE Prom 51, transmitter 15, receiver 88, and memory 90 are not shown as details of such components are well known in the art.

The particular embodiment of the processing unit and transmitter shown in FIG. 2 is a multipurpose one to which a number of different sensing devices, such as the panic button 35, fire detector 38, intrusion detector 31 or other devices may be connected. The interface (not shown) between the sensing devices such as 35, and the processing circuitry 36 is arranged so that the triggering of the device places a low signal on line 56 and on one of the input lines 57, 58 and 59. The details of the sensing devices 31, 35 and 38 as well as the interface will not be described in detail as these are well known in the art.

The processing circuit, such as 36, includes microcomputer 50, EE Prom 51, timer 53, inverter 54, ceramic resonator 62, resistors 63 through 66, capacitor 68 and diodes 70, 71 and 72. The processing circuit 36 also includes a power supply (not shown) which provides the voltage source required to use the circuitry, such as Vdd (75) and the ground, such as 76. Finally, the processing circuit 36 also includes a battery status circuit (not shown) which provides a low signal on line 60 when the battery charge drops below a certain level. The power supply and battery status circuits are know in the art.

The number 1 pin of microcomputer 50 is connected to ground through ceramic resonator 62 and to the Vdd voltage through resistor 63. The number 2 pin is connected to the Vdd voltage. The number 3 pin is connected to the number 26 pin. The number 28 pin is connected to the output of inverter 54 through resistor 64. The input of inverter 54 is connected to input line 56. The number 28 pin is also connected to the number 27 pin through resistor 65 and diode 70 in parallel, with the cathode of the diode toward the number 28 pin. The number 27 pin is also connected to ground through capacitor 68. The number 6 through 9 pins are connected to inputs 57 through 60. The number 24 pin is connected to the output of timer 53. The output of timer 53 is also connected to the input of inverter 54 through diode 71, with the cathode of the diode toward the timer. The number 25 pin is connected to the data output of EE Prom 51. The number 4 and 5 pins are connected to the system ground. The number 16 pin of the microcomputer 50 is connected to the (MR) input of timer 53 and to ground through resistor 66. The number 14 pin is connected to the input of inverter 54 through diode 72 with the cathode of the diode toward the microcomputer. The number 13 pin is connected to the power on input of the transmitter 15 and the number 17 pin is connected to the data input of the transmitter. The number 15 pin is connected to the power on input to the EE Prom 51. Pins 10, 11 and 12 are connected to the data input, chip select, and clock inputs, respectively, of EE Prom 51.

FIG. 3 shows the various components associated with central unit 18 and their connections to microprocessor 80. These components include tape deck 81, interface 83, programming unit 85, interface 87, receiver 88, power supply 89, memory 90, parallel outputs 91, parallel inputs 92, serial outputs 93, remote function 94, oscillator 99, transistor 100, resistors 101 through 105 and capacitors 109 and 110. The number 2 and 3 pins of microprocessor 80 are connected to the programming inputs of the central unit 18. Programming unit 85 may be connected to these pins through an interface 87 or alternatively tape deck 81 may be connected through its interface 83. These components, 85 and 87 or 81 and 83, generally are connected only during the programming of the unit 18. The number 40 pin of microprocessor 80 is connected to the Vcc system voltage source and to the data output of receiver 88 through resistor 101. The data output of receiver 88 is also connected to pin 4 of the microprocessor. Pin 12 is connected to the carrier detect output of receiver 88 and to the Vcc voltage through resistor 102. The number 9 pin is connected to the drain of transistor 100 and to the Vcc voltage through resistor 103. The source of transistor 100 is connected to ground and the gate is connected to the reset output of the power supply 89. The power supply 89 provides the Vcc voltage 114 and a ground 115 for the system. The number 13 pin is connected to the Vcc voltage through resistor 104. The number 18 pin of microprocessor 80 is connected to the number 19 pin through oscillator 99 and to ground through capacitor 109. The number 19 pin is also connected to ground through capacitor 110. The number 20 pin is grounded and the number 31 pin is connected to ground through resistor 105. The number 6, 10, 11, 14 and 15 pins are connected to various remote functions, such as a modem, dialer etc. These functions include the telephone line 23 (FIG. 1). Pins 1, 7 and 8 are connected to the serial outputs which may include relays and other devices. The number 5 pin is connected to the reset input of the smoke detector auxiliary power circuit. The number 32–39 pins provide the parallel input/output function and are connected to both the parallel outputs, such relays, LED's 20 and buzzer 21 and to the parallel inputs, which may include hardwired inputs to various sensors (providing a hardwire option for the system) and to various status inputs such as the battery and the memory unit. The number 16, 17, and 21–30 pins are connected to the central memory unit 90.

In the preferred embodiment of the invention, the parts of the circuits of FIGS. 2 and 3 are as follows: microcomputer 50 is a PIC 16C58, EE Prom 51 includes either an ER59256 or NMC9306N chip plus the FET and related circuitry to power the chip. Transmitter 15 may be one of many digital transmitters known in the art plus associated buffers, transistors, etc. to turn on and off the transmitter and to shape the data prior to transmitting it. Timer 53 includes a 4541 programmable timer and its associated components, inverter 54 is one of a Schmitt trigger hex inverter package type 40106, resonator 62 is a 2M hertz ceramic resonator, resistors 63, 64, 65 and 66 are 2.2M ohm, 4.7K ohm, 82K ohm and 100K ohm respectively, capacitor 68 is 0.1M farad, and diodes 70, 71 and 72 are type 1N4148. Microprocessor 80 is preferably an Intel 8031 microcontroller, tape deck 81 and interface 83 may be a cassette deck or any other type of tape deck with an appropriate interface to match it with the microprocessor, programming unit 85 and interface 87 may be any mini, personal, or other type computer, with appropriate interfacing, receiver 88 may be one of many such receivers in the art, while the power supply, memory, parallel outputs and inputs, serial outputs and remote functions are all devices which are well known in the art. Preferably resistors 101, 102, and 104 are 10K ohm while 103 and 105 are 4.7K ohm and 1K ohm respectively, capacitors 109 and 110 are 30 picofarads, oscillator 99 is an 8 megahertz crystal, and transistor 100 is a type VN10KM.

Figure 4:
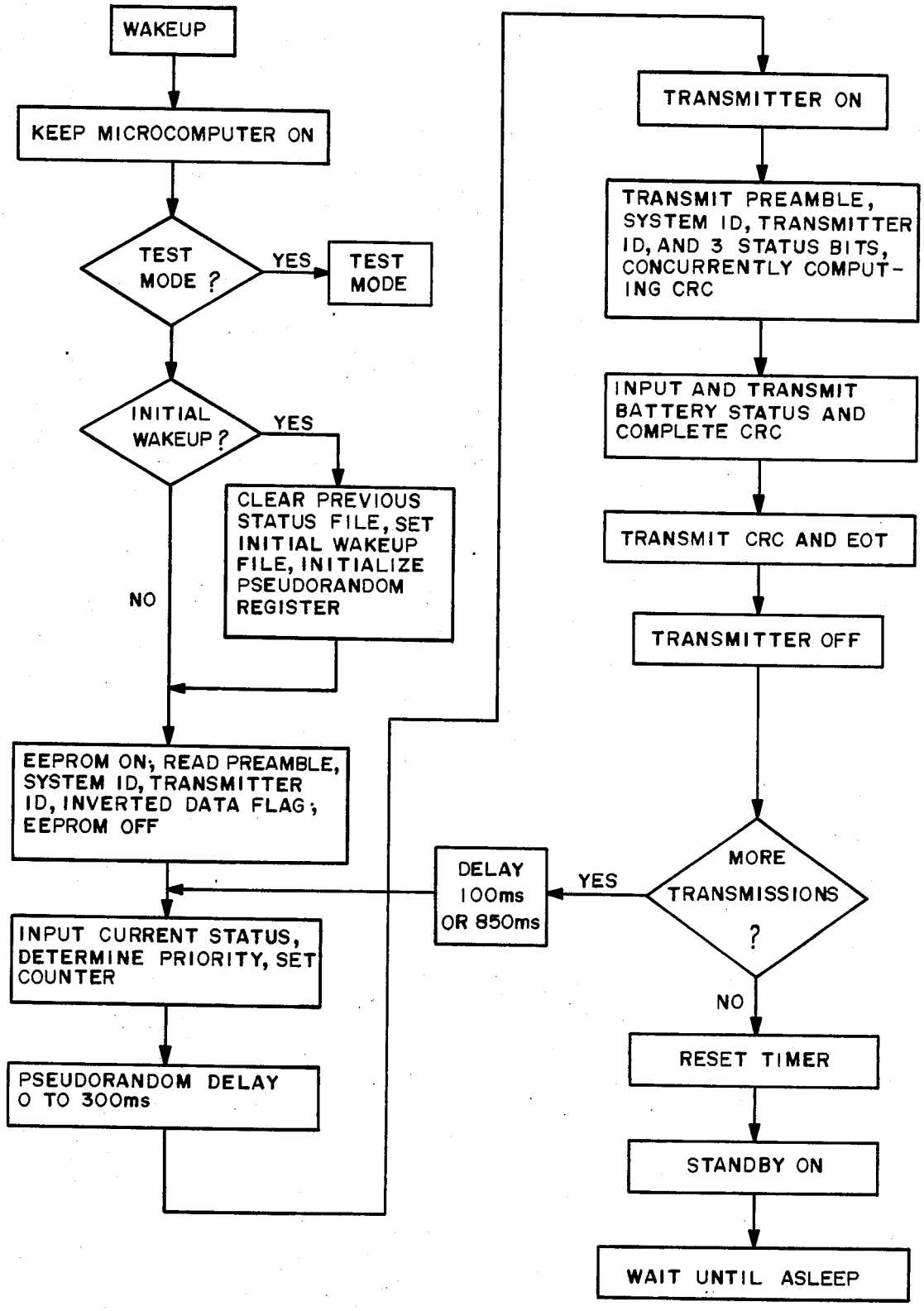
FIG. 4 is a flow chart showing the steps of the preferred microcomputer program for the sending unit according to the invention.

FIG. 4 shows a flow chart of the microcomputer 50 program according to the invention. Following the flow chart and referring to FIG. 2, the transmitter portion of the invention functions as follows. To conserve battery power, microcomputer 50 is normally held in stand-by by a low signal on pin 28. The timer 53, however, operates continuously as long as a battery with sufficient charge is connected to the system. The timer 53 is programmed to change its output (the line connected to the cathode of diode 71) from high to low at appropriate times to make a supervisory report. This low signal is applied to the input of inverter 54 which causes its output to go high, placing a high signal on pin 28 of microcomputer 50 to turn it on. Or, a low signal from any one of the sensing devices (such as 31, 35 or 38) connected to input 56 will also place a high signal on microcomputer input pin 28 to turn it on. A short time after pin 28 goes high, pin 27 also goes high (with a delay determined by resistor 65 and capacitor 68) and clears the microcomputer. Once turned on, the microcomputer drives its number 14 pin low to keep itself on. It then initializes the software, turns on the EE Prom 51 by placing a high signal on pin 15, enables the EE Prom by placing a high signal on pin 11 (chip select), reads the sending unit identification data from the EE Prom on pin 25 while clocking the EE Prom with a signal output on pin 12 and sending the address from which the data is to be read via pin 10. The identification data consists of a preamble, system identification number, and transmitter identification number. The microcomputer 50 adds the current status (as defined by the inputs 6 through 8) to the identification data to provide a data signal to be transmitted. The microcomputer 50 then computes a 4-bit pseudo-random number (0 through 15) as follows: a 15-bit shift register is initialized with a non-zero value. The contents of the register are shifted left, with the right-most bit (bit 1) replaced by the exclusive-OR of bits 14 and 15 (the two left-most bits). This new number in the register is the pseudo-random number which is used to determine the number of 20 millisecond delay loops to be executed by the microcomputer. This randomized delay may be from 0 to 300 milliseconds (15×20 milliseconds) and will average 150 milliseconds. Each successive shift of the 15-bit register will generate a new 15-bit number in a pseudo-random sequence. The sequence repeats after 32,767 numbers have been generated. Only 4-bits from the 15-bit number are used to determine the randomized delay.

The microcomputer 50 waits through the number of loop time periods determined by the pseudo-random number, then applies a high signal on pin 13. This high signal turns on the transmitter 15 and battery level indicator circuit (not shown). The preamble, system identification number, transmitter identification number and status are Manchester encoded and output on pin 17. The battery status is then read on line 9 (a low signal indicates a a low battery), encoded, and transmitted while a Cyclic Redundancy Check Code (CRC) is calculated as follows: If the data is A8, . . . , A1, T6, . . . , T1, S4, . . . , S1, where A1 through A8 represent the 8-bit system identifier code, T1 through T6 represent the 6-bit transmitter code, and S1 through S4 represent the 4-bit sensor status code, then, using algebraic coding theory, the data plus the CRC can be interpreted as an algebraic polynominal, namely, $A8\ a^{22}+A7\ a^{21} \ldots +Sla^5+C5a^4+C4a^3+C3a^2+C2a+C1$, where C5 through C1 is a 5-bit CRC. Algebraic coding theory states that the CRC should be chosen so that the above polynominal which we shall refer to as the "first polynominal" is exactly divisible by a second polynominal. In the preferred embodiment, the second polynominal is chosen as $a^{5}+a^2+1$. The CRC may be determined by dividing the first polynominal with the CRC set to zero (C1 through C5 set to zero) by the second polynominal, and the remainder will then be the CRC. The preferred division process is performed in microcomputer 50 by a software-implemented shift register with feedback. In the preferred embodiment, a 6-bit shift register is implemented with feedback from the 6-bit added without carry to bits one and three. The calculated CRC and an end of transmission signal (EOT) are then Manchester encoded and transmitted, then the transmitter is turned off. After a supervisory transmission (activated by timer 53), the microcomputer then resets the timer by a high signal on pin 16 and returns itself to stand-by-by. Non-supervisory transmissions, however, are repeated with a predetermined fixed delay plus a pseudo-random delay before the microcomputer resets the timer and returns to stand-by. If the condition to be reported is on pins 6 or 7, the transmission is repeated nine times with a 100 millisecond predetermined fixed delay plus the random delay. If the condition to be reported is on input 8 (the panic button input), the transmitter is usually a portable unit. Because the transmitter's location is not fixed, signal strength may be marginal, so the transmission is repeated thirty times with an 850 millisecond fixed delay plus the random delay. In the preferred embodiment, the transmitted data word lasts 18 milliseconds. Supervisory transmission reporting is set to about 60 seconds by programming timer 53.

Figure 9:
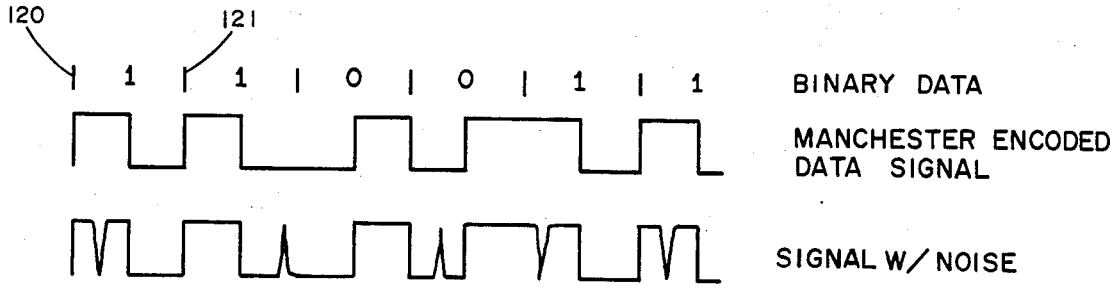
FIG. 9 illustrates a Manchester encoded signal and the same signal with noise.

An example of Manchester encoded date is shown in FIG. 9. The lines, such as 120 and 121 mark the edges of a bit cell. The sample binary data bit is 110011. In Manchester encoding, the binary bit cell is divided into halves, with the first half set at the true value of the bit (which is 1 in the bit cell bounded by lines 120 and 121), and the second half at the inverted value. (Alternatively, the definition could be reversed). Thus there is always a transition from either high to low, or low to high in the middle of each bit cell. Manchester encoding is also referred to as diphase encoding. During transmission and reception noise may be added to the signal as shown in the bottom line of FIG. 9.

Figure 5:
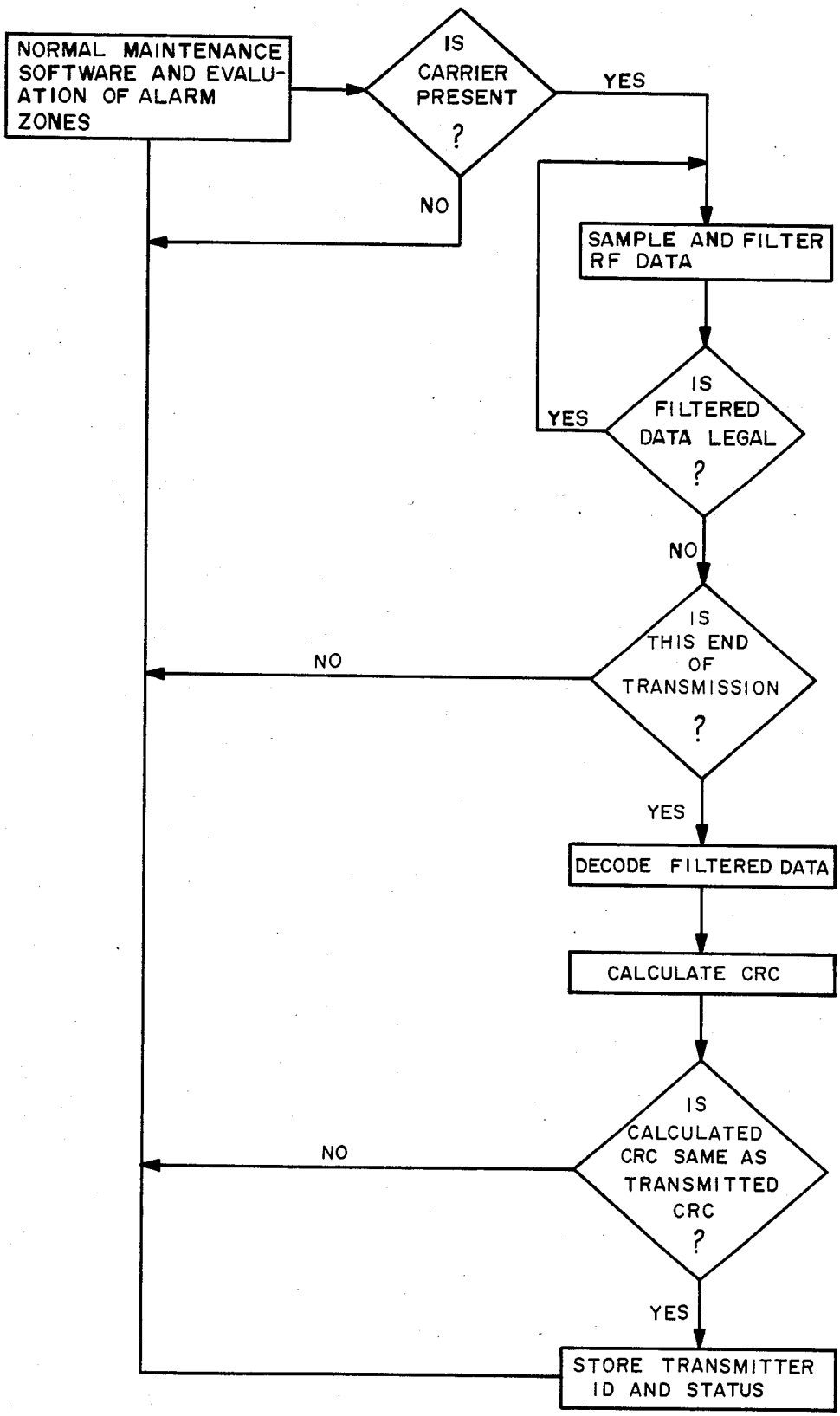
FIG. 5 is a flow chart showing the steps of the preferred embodiment of the microprocessor program for the receiving unit according to the invention.
Figure 6:
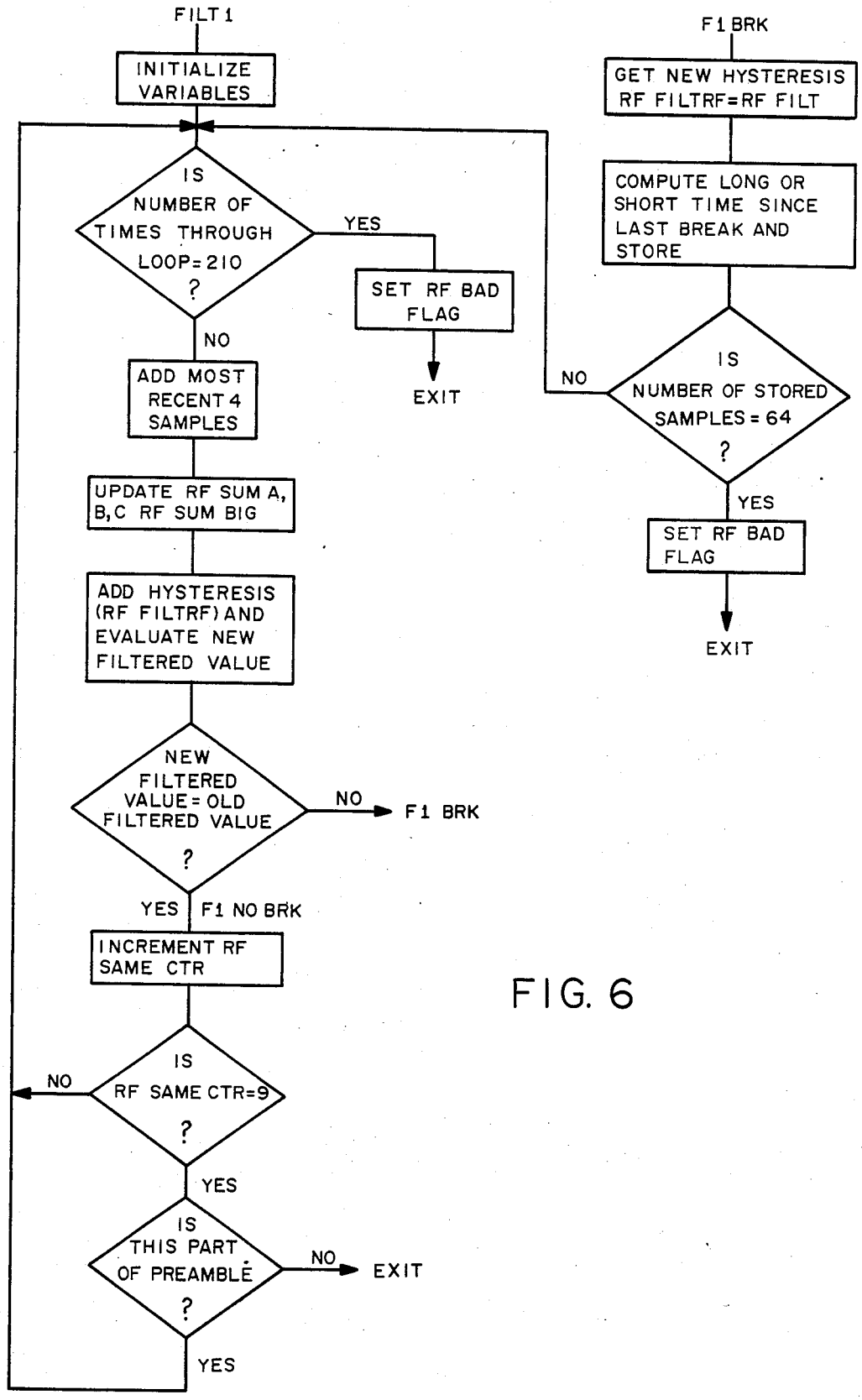
FIG. 6 is a flow chart of a sub-routine of the program of FIG. 5 showing the preferred embodiment of the data filtering and checking subprograms.
Figure 8:
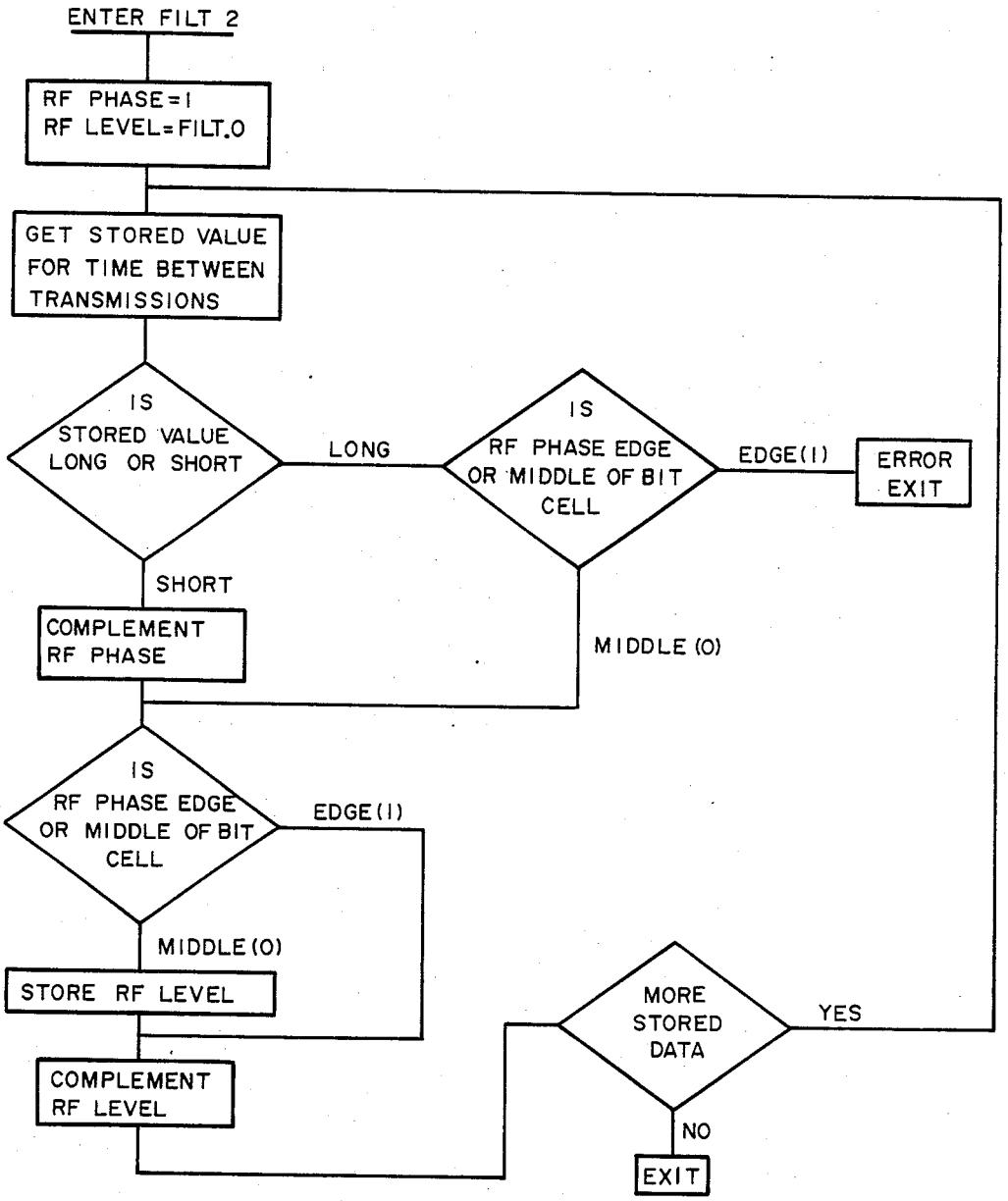
FIG. 8 is a flow chart of another subroutine of the program of FIG. 5 showing the preferred embodiment of the subroutine for decoding and further checking the filtered data.

Turning now to the operation of the receiver unit 18, a flow chart of the main program of microprocessor 80 is shown in FIG. 5, a flow chart of the filtering and checking operations is shown in FIG. 6, and a flow chart of the decoding operation is shown in FIG. 8. Referring to FIG. 3 and the flow charts, the receiver unit functions as follows: The transmitted signal is received by receiver 88 via antenna 42. Upon reception of a signal, the receiver puts a low signal on its carrier detect output which is applied to pin 12 of microprocessor 80 to activate the signal processing routines. Note that the preamble of the transmitted signal initiates the signal processing function so that by the time the data arrives the microprocessor 80 is ready to process it.

The microprocessor, in performing its maintenance and evaluation routines (which are not directly related to the present invention and thus will not be discussed in detail), checks to see if there is a carrier present. If not, the system returns to the maintenance programs. If so, the microprocessor samples the signal on input pin 4, then goes to the Filt 1 subprogram of FIG. 6 to filter the data. In the preferred embodiment the transmitter and receiver timing are set so the RF data line (pin 4) is sampled at the rate of 24 samples per bit cell. The transmission rate is set by ceramic resonator 62 (FIG. 2) in the transmission unit and the sampling rate is set by crystal controlled oscillator 99 in the receiving unit.

The Filt 1 subprogram initializes the variables RF SUM A, RF SUM B, RF SUM C, RF SUM BIG, RF FILT RF, RF FILT, and RF SAME CTR to 4, 0, 0, 4, 3, 3, and 1 respectively. Then a moving average of twelve RF data samples (each sample having a value of 1 or 0) is computed in two steps. The sum of the most recent four samples is stored in the variable called RF SUM A, the sum of the next oldest four in RF SUM B, and of the oldest four in RF SUM C. When four new samples are acquired, their sum is stored in RF SUM A, the old value of RF SUM A is stored in RF SUM B, and the old value of RF SUM B is stored in RF SUM C. With each four new samples a total of these three variables is computed and stored in RF SUM BIG. The value of RF SUM BIG can, thus, be between 0 and 12, and is proportional to the moving average of 12 samples (equivalent to half of a bit cell). If the RF data line is high for half of a bit cell (as is true in noise-free Manchester encoded data) then RF SUM BIG will rise to 12, and if it is low for half of a bit cell then RF SUM BIG will fall to 0. RF SUM BIG is used to determine the filtered value of the RF data. With each new computation of RF SUM BIG, a new filtered value is determined: if the old filtered value was low (0), then the new filtered value is low if RD SUM BIG is 7 or less and is high if RF SUM BIG is 8 or greater. If the old filtered value was high (1), then the new filtered value is low if RF SUM BIG is 4 or less and is high if RF SUM BIG is 5 or more. This procedure introduces hysteresis in the filtering process to afford greater immunity to noise.

The filtered value of the RF data itself is not stored for future use; instead, the number of times the filtered value is evaluated and remains the same is temporarily stored in a software counter (RF SAME CTR). Each time the moving average is calculated and remains the same, RF SAME CTR is incremented. When a transition of the filtered value occurs (as defined by the rules in the previous paragraph), a subroutine Fl BRK is entered which evaluates RF SAME CTR as being a long (1) or short (0) time since the previous transition. For noise-free Manchester encoded data the minimum time between transitions is equal to half of a bit cell (RF SAME CTR=3), and the maximum time is one bit cell (RF SAME CTR=6). To allow for some distortion of the data due to noise, a short time (0) is defined for RF SAME CTR values 1 through 4, and a long time (1) is defined for RF SAME CTR values 5 through 8.

Figure 7:
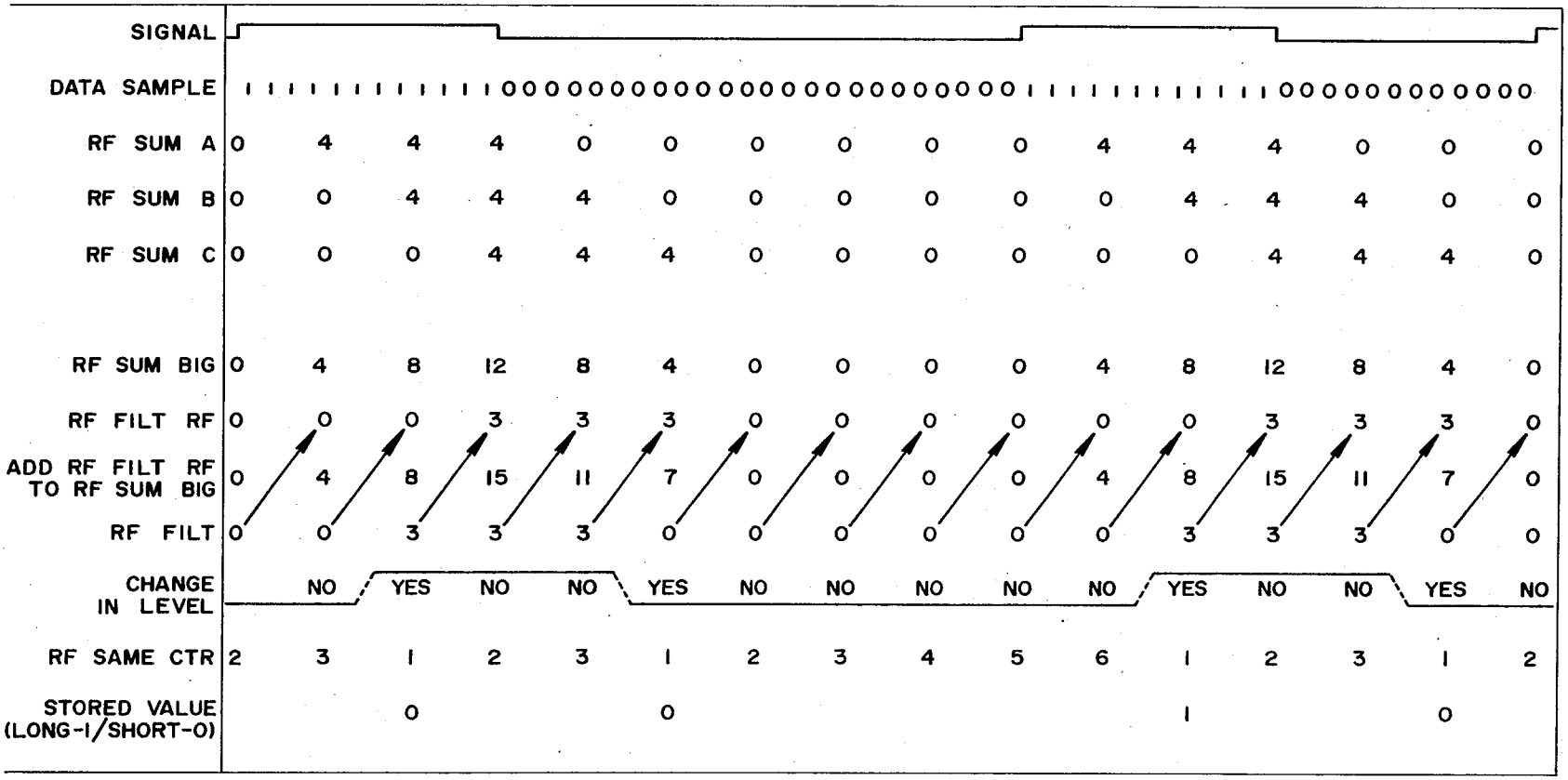
FIG. 7 shows an example of data filtering as performed by the subroutine of FIG. 6.

If the number of stored samples is 64 or greater after evaluation of RF SAME CTR, the RF signal is declared bad and the filtering subprogram is exited. If the number of stored samples is less than 64, the program control returns to the start of the filtering loop. Values of RF SAME CTR greater than 8 are declared illegally long and, therefore, end the filtering process (this test is not applied at the beginning of the received data to allow the non-Manchester encoded preamble to pass through). An example of the filtering of a Manchester encoded signal is shown in FIG. 7. The sample signal is shown at the top. Immediately under the signal sample the sampled data values (1 or 0) are given. The steps by which the software filtering process averages the data and records transitions and the long or short value of RF SAME CTR may be followed by reading each successive column starting at the left from top to bottom. A constant value two bit cells long, and equal in value to the true value of the last data bit, is transmitted immediately following the last data bit to indicate the end of transmission (EOT). This completes the RF data acquisition and filtering portion of the subroutine; program control is then transferred to the decoding subroutine.

A flow chart of the decoding subroutine is shown in FIG. 8. The subroutine checks the stored information from the filtering routine for conformance to rules regarding transitions in Manchester encoded data, and reconstitutes the encoded binary data for use by the normal maintenance software. In Manchester encoded data a transition must occur in the middle of a bit cell, but may or may not occur at the bit cell boundaries. A transition at the bit cell boundary occurs when the binary value is repeated; no transition occurs when the binary value changes from one cell to the next. Two variables are used to keep track of the decoding process: RF PHASE and RF LEVEL. RF PHASE keeps track of whether a transition is at the edge of a bit cell (1) or in the middle (0). The decoding is performed in the reverse direction from which the data was received, starting from the end of transmission marker. Since the marker indicates the edge of a bit cell, RF PHASE is initialized with the value 1. It is complemented on each loop through the subroutine for which the stored value for time between transmissions is short. If the time is long, then RF PHASE must be 0 (the middle of a bit cell) and RF PHASE is not complemented. If the time is long and RF PHASE=1 then the data has been corrupted by noise to the point that it cannot be recovered, so it is discarded. RF LEVEL keeps track of the level of the reconstituted data. It is initialized to the filtered value of the end of transmission marker. RF LEVEL is stored as the decoded data when RF PHASE is 0, and is complemented on each loop through the subroutine (i. e. with each transition). This process continues until there is no more stored data, when control is transferred to the CRC subroutine.

Figure 10:
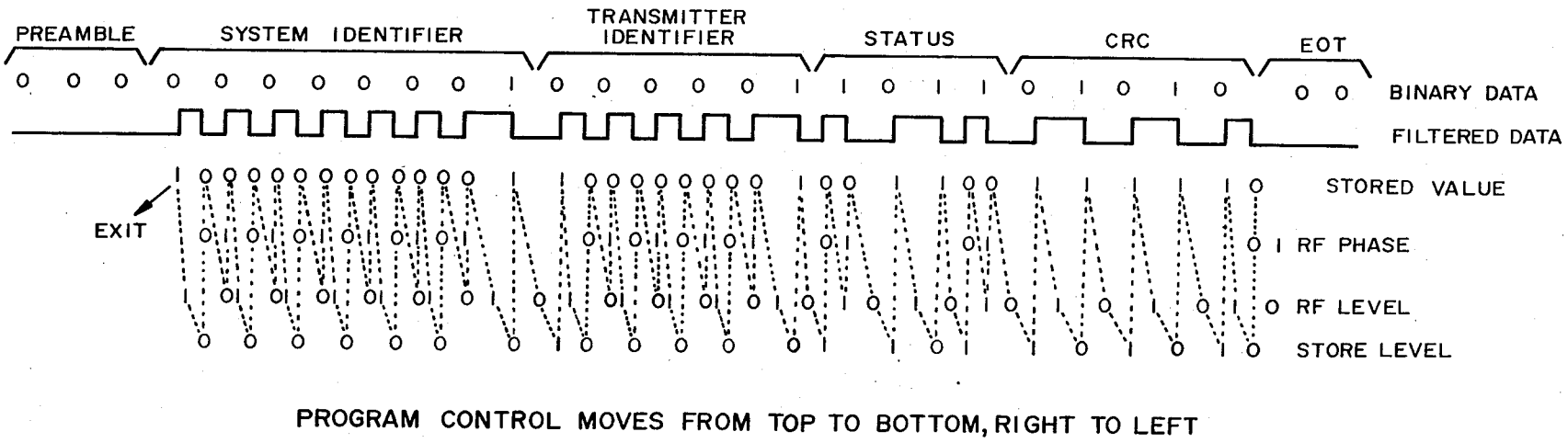
FIG. 10 shows an example of the data decoding as performed by the subroutine of FIG. 8.

An example of the decoding of a complete transmission is shown in FIG. 10. The data signal transmitted is shown in the top line in binary notation and in the second line in the Manchester encoded form. The decoding operations may be followed by reading the columns from top to bottom starting at the right most column and proceeding to the left. The result of the decoding process can be checked for this example by comparing the bottom line (store level) with the original binary data.

In the CRC subroutine, the microprocessor 80 calculates a CRC, using the received data signal in the same manner as described above in the discussion of the microcomputer software (FIG. 4). The resulting remainder, or second CRC is subtracted from the received CRC and if they are the same the result will be zero and the received signal is stored. If the result is non-zero the received signal is not stored and control returns to the normal maintenance software and evaluation of the alarm zones. This software reads the stored data and activates the outputs as the data requires.

The preferred embodiment of the software subroutines which filter, check and decode the data are given at the end of the description of the invention, before the claims.

The invention greatly improves the reliability of communications over previous RF linked security systems. The moving average filtering technique removes brief, noise- induced transitions from the received data. It will restore the data with up to 30% noise in an individual bit. Greater levels of noise prevent the data from being correctly recovered; however, several levels of software protection are provided to prevent noise corrupted data from being interpreted as erroneous alarm indications. First, the software eliminates short noise transitions, so the tendency with increasing levels of noise is for the time between transitions to become longer. If the time between transitions becomes greater than 1.5 bit cells, it is interpreted as the end of transmission (EOT) marker (except for the preamble). As the filtered data is decoded, it is tested for conformance to rules regarding transitions in Manchester encoded data. These two tests provide strong protection against data which has been greatly corrupted by noise, since it is unlikely that noise would generate more than a few bits which meet these requirements. At a higher system level, the cyclic redundancy check provides a high probability of detecting fewer than 4 errors, and the requirement that the received 8-bit system identifier match that stored in the receiving unit provides further insurance against corrupted data being misinterpreted as valid alarm data. The combination of all these elements provides this system with the capability of receiving and reading data in noisier environments than previous systems, and also of being more confident of the validity of the data than in previous systems.

A novel security system apparatus and method which provides for restoring noisy data signals and reliable accuracy checking of the data signal has been described. It is evident that those skilled in the art may now make many different embodiments and applications of the system without departing from the inventive concepts. For example, different software programming may be employed. Or the calculations may be performed using hardware or hard-wired circuits rather than software. Equivalent electronic parts and components may be used. Accordingly, the present invention is to be construed as embracing each and every novel feature and novel combination of features present in the detection system described without limitation by the particular embodiment used to illustrate the invention.

DATA FILTERING, CHECKING AND DECODING SUBROUTINES

```
LOC  OBJ                LINE  SOURCE
                   =1   1520  ;*****************************
                   =1   1521  CRC TEST:
0851  7800       F =1   1522                MOV    R0,#(F2 BUF+1)
0853  7A07         =1   1523                MOV    R2,#7
0855  7B12         =1   1524                MOV    R3,#18
                   =1   1525
0857  E6           =1   1526                MOV    A,@R0
0858  23           =1   1527                RL     A
0859  FC           =1   1528                MOV    R4,A
085A  7D00         =1   1529                MOV    R5,#0
                   =1   1530  CT LOOP:
085C  EC           =1   1531                MOV    A,R4
085D  33           =1   1532                RLC    A
085E  FC           =1   1533                MOV    R4,A
                   =1   1534
085F  ED           =1   1535                MOV    A,R5
0860  33           =1   1536                RLC    A
0861  FD           =1   1537                MOV    R5,A
0862  A2E5         =1   1538                MOV    C,ACC.5
0864  5420         =1   1539                ANL    A,#20H
0866  92E2         =1   1540                MOV    ACC.2,C
0868  92E0         =1   1541                MOV    ACC.0,C
086A  6205         =1   1542                XRL    AR5,A
086C  DB02         =1   1543                DJNZ   R3,CT NEXT
086E  8009         =1   1544                SJMP   CT WRAP
                   =1   1545  CT NEXT:
0870  DAEA         =1   1546                DJNZ   R2,CT LOOP
0872  7A08         =1   1547                MOV    R2,#8
0874  08           =1   1548                INC    R0
0875  8604         =1   1549                MOV    AR4,@R0
0877  80E3         =1   1550                JMP    CT LOOP
                   =1   1551  CT WRAP:
0879  E500       F =1   1552                MOV    A,F2 BUF+3
087B  541F         =1   1553                ANL    A,#1FH
087D  6D           =1   1554                XRL    A,R5
087E  6003         =1   1555                JZ     CT GOOD
0880  D3           =1   1556                SETB   C
0881  8001         =1   1557                SJMP   CT EXIT
                   =1   1558  CT GOOD:
0883  C3           =1   1559                CLR    C
                   =1   1560  CT EXIT:
0884  22           =1   1561                RET
                   =1   1562  ;*****************************
                   =1   1563  $EJ
                   =1   1564  ;*****************************
                   =1   1565  FILT 1:
0099               =1   1566  TASK REF      SET    TASK REF+1
0885  7499         =1   1567                MOV    A,#TASK REF
0887  C0E0         =1   1568                PUSH   ACC
                   =1   1569
0889  900000     F =1   1570                MOV    DPTR,#LED BUZZER ADDR
088C  E500       F =1   1571                MOV    A,LED BUZZER BUF
088E  4408         =1   1572                ORL    A,#08H
0890  F500       F =1   1573                MOV    LED BUZZER BUF,A
0892  F0           =1   1574                MOVX   @DPTR,A
                   =1   1575
0893  C200       F =1   1576                CLR    RF BAD
0895  00           =1   1577                NOP
0896  00           =1   1578                NOP
0897  00           =1   1579                NOP
                   =1   1580
0898  750001     F =1   1581                MOV    RF RAW A,#(1-RF QUIET)
089B  750001     F =1   1582                MOV    RF RAW B,#(1-RF QUIET)
089E  750001     F =1   1583                MOV    RF RAW C,#(1-RF QUIET)
08A1  750001     F =1   1584                MOV    RF RAW D,#(1-RF QUIET)
                   =1   1585
08A4  750004     F =1   1586                MOV    RF SUM A,#4*(1-RF QUIET)
08A7  750000     F =1   1587                MOV    RF SUM B,#4*RF QUIET
08AA  750000     F =1   1588                MOV    RF SUM C,#4*RF QUIET
08AD  A200       F =1   1589                MOV    C,RF INPUT
08AF  9200       F =1   1590                MOV    RF RAW B.O,C
08B1  750004     F =1   1591                MOV    RF SUM BIG,#(4+4*RF QUIET)
                   =1   1592
08B4  750003     F =1   1593                MOV    RF FILT,#3*(1-RF QUIET)
08B7  750003     F =1   1594                MOV    RF FILTRF,#3*(1-RF QUIET)
```

-continued

DATA FILTERING, CHECKING AND DECODING SUBROUTINES

```
LOC  OBJ        LINE  SOURCE
08BA 750001     F =1 1595                MOV    RF SAME CTR,#1
                =1 1596
08BD 75000D2    F =1 1597                MOV    RF LOOP CTR, #210D
08C0 00         =1 1598                  NOP
08C1 00         =1 1599                  NOP
08C2 A200       F =1 1600                       MOV C,RF INPUT
08C4 9200       F =1 1601                       MOV RF RAW C.O,C
08C6 7A1B       =1 1602                  MOV    R2,#27D
                =1 1603
08C8 750008     F =1 1604                MOV    RF RAW BIT,#8
08CB 750008     F =1 1605                MOV    RF RAW BYTE,#8
                =1 1606
08CE 900000     F =1 1607                MOV    DPTR,#LCD RD INST
08D1 E0         =1 1608                  MOVX   A,@DPTR
08D2 20E7FC     =1 1609                  JB     ACC.7,$-1
08D5 A200       F =1 1610                       MOV C,RF INPUT
08D7 9200       F =1 1611                       MOV RF RAW D.O,C
                =1 1612
08D9 900000     F =1 1613                MOV    DPTR,#LCD WR INST
08DC 74A8       =1 1614                  MOV    A,#0A8H
08DE F0         =1 1615                  MOVX   @DPTR,A
08DF 900000     F =1 1616                MOV    DPTR,#HARD STATUS
                F =1 1617        $EJ
                =1 1618        ;*****************************************
                =1 1619        ;*****************************************
                =1 1620        F1 LOOP:
08E2 D50007     F =1 1621                DJNZ   RF LOOP CTR,F1 LOOP MORE
08E5 D200       F =1 1622                SETB   RF BAD
08E7 020000     F =1 1623                JMP    F1 WRAP
                =1 1624        F1 LOOP SAME:
08EA 800C       =1 1625                  SJMP   F1 LOOP ADD
                =1 1626        F1 LOOP MORE:
08EC 00         =1 1627                  NOP
08ED 00         =1 1628                  NOP
08EE 00         =1 1629                  NOP
08EF A200       F =1 1630                       MOV C, RF INPUT
08F1 9200       F =1 1631                       MOV RF RAW A.O,C
08F3 DAF5       =1 1632                  DJNZ   R2,F1 LOOP SAME
08F5 7A1B       =1 1633                  MOV    R2,#27D
08F7 09         =1 1634                  INC    R1
                =1 1635        F1 LOOP ADD:
08F8 E500       F =1 1636                MOV    A,RF RAW A
08FA 2500       F =1 1637                ADD    A,RF RAW B
08FC 2500       F =1 1638                ADD    A,RF RAW C
08FE 2500       F =1 1639                ADD    A,RF RAW D
                =1 1640
0900 C500       F =1 1641                XCH    A,RF SUM A
0902 C500       F =1 1642                XCH    A,RF SUM B
0904 C500       F =1 1643                XCH    A,RF SUM C
0906 C500       F =1 1644                XCH    A,RF SUM BIG
0908 A200       F =1 1645                       MOV C,RF INPUT
090A 9200       F =1 1646                       MOV RF RAW B.O,C
090C 2500       F =1 1647                ADD    A,RF SUM A
090E C3         =1 1648                  CLR    C
090F 9500       F =1 1649                SUBB   A,RF SUM BIG
0911 F500       F =1 1650                MOV    RF SUM BIG,A
                =1 1651
0913 2500       F =1 1652                ADD    A,RF FILTRF
0915 A2E3       =1 1653                  MOV    C,ACC.3
0917 9200       F =1 1654                MOV    RF FILT.1,C
0919 9200       F =1 1655                MOV    RF FILT.0,C
091B E500       F =1 1656                MOV    A,RF FILT
091D B50007     F =1 1657                CJNE   A,RF FILTRF,F1 BRK
0920 A200       F =1 1658                       MOV C, RF INPUT
0922 9200       F =1 1659                       MOV RF RAW C.O,C
0924 020000     F =1 1660                JMP    F1 NO BRK
                =1 1661        $EJ
                =1 1662        ;.......................................
                =1 1663        F1 BRK:
0927 A200       F =1 1664                       MOV C,RF INPUT
0929 9200       F =1 1665                       MOV RAW C.O,C
092B F500       F =1 1666                MOV    RF FILTRF,A
092D 7401       =1 1667                  MOV    A,#1
092F C500       F =1 1668                XCH    A,RF SAME CTR
0931 24FB       =1 1669                  ADD    A,#(-5)
                =1 1670
0933 C500       F =1 1671                XCH    A,RF CURR
0935 33         F =1 1672                RLC    A
0936 C500       F =1 1673                XCH    A,RF CURR
0938 D50018     F =1 1674                DJNZ   RF RAW BIT,F1 SAME BYTE
```

-continued

DATA FILTERING, CHECKING AND DECODING SUBROUTINES

```
LOC  OBJ                LINE  SOURCE
                   =1   1675  ;.....................................
093B 900000      F =1   1676                 MOV     DPTR,#LCD WR DATA
093E E500        F =1   1677                 MOV     A,RF CURR
0940 A200        F =1   1678                         MOV C,RF INPUT
0942 9200        F =1   1679                         MOV RF RAW D.O.C
0944 F0            =1   1680                 MOVX    @DPTR,A
0945 900000      F =1   1681                 MOV     DPTR,#HARD STATUS
0948 750008      F =1   1682                 MOV     RF RAW BIT, #8
094B D50094      F =1   1683                 DJNZ    RF RAW BYTE,F1 LOOP
094E D200        F =1   1684                 SETB    RF BAD
0950 020000      F =1   1685                 JMP     F1 WRAP
                   =1   1686  ;.....................................
                   =1   1687  F1 SAME BYTE:
0953 00            =1   1688                 NOP
0954 B296          =1   1689                 CPL     P1.6
0956 B296          =1   1690                 CPL     P1.6
0958 A200        F =1   1691                         MOV C,RF INPUT
095A 9200        F =1   1692                         MOV RF RAW D.O.C
095C 00            =1   1693                 NOP
095D 00            =1   1694                 NOP
095E 00            =1   1695                 NOP
095F 00            =1   1696                 NOP
0960 00            =1   1697                 NOP
0961 00            =1   1698                 NOP
0962 020000      F =1   1699                 JMP     F1 LOOP
                   =1   1700  $EJ
                   =1   1701  ;.....................................
                   =1   1702  F1 NO BRK:
0965 00            =1   1703                 NOP
0966 00            =1   1704                 NOP
0967 00            =1   1705                 NOP
0968 00            =1   1706                 NOP
0969 00            =1   1707                 NOP
096A 00            =1   1708                 NOP
096B A200        F =1   1709                         MOV C,RF INPUT
096D 9200        F =1   1710                         MOV RF RAW D.O.C
096F B296          =1   1711                 CPL     P1.6
0971 B296          =1   1712                 CPL     P1.6
0973 0500        F =1   1713                 INC     RF SAME CTR
0975 E500        F =1   1714                 MOV     A,RF SAME CTR
0977 B40909        =1   1715                 CJNE    A,#9,F1 LEN OK
                   =1   1716
097A E500        F =1   1717                 MOV     A,RF LOOP CTR
097C 246A          =1   1718                 ADD     A,#(-150D)
097E 500A          =1   1719                 JNC     F1 ALIGN
0980 020000      F =1   1720                 JMP     F1 LOOP
                   =1   1721  F1 LEN OK:
0983 00            =1   1722                 NOP
0984 00            =1   1723                 NOP
0985 00            =1   1724                 NOP
0986 00            =1   1725                 NOP
0987 020000      F =1   1726                 JMP     F1 LOOP
                   =1   1727                 ;.....................................
                   =1   1728  F1 ALIGN:
098A 900000      F =1   1729                 MOV     DPTR,#LCD WR DATA
098D E500        F =1   1730                 MOV     A,RF CURR
098F F0            =1   1731                 MOVX    @DPTR,A
                   =1   1732  F1 WRAP:
0990 900000      F =1   1733                 MOV     DPTR,#LED BUZZER ADDR
0993 E500        F =1   1734                 MOV     A,LED BUZZER BUF
0995 54F7          =1   1735                 ANL     A,#0F7H
0997 F500        F =1   1736                 MOV     LED BUZZER BUF,A
0999 F0            =1   1737                 MOVX    @DPTR,A
                   =1   1738
099A 7499          =1   1739                 MOV     A,#TASK REF
099C 120000      F =1   1740                 CALL    TASK CHECK
099F D0E0          =1   1741                 POP     ACC
09A1 22            =1   1742                 RET
                   =1   1743  $EJ
                   =1   1744  ;*****************************************
                   =1   1745  ;*****************************************
                   =1   1746
                   =1   1747
                   =1   1748
                   =1   1749
                   =1   1750
                   =1   1751
                   =1   1752
                   =1   1753
                   =1   1754
```

-continued

DATA FILTERING, CHECKING AND DECODING SUBROUTINES

```
LOC  OBJ          LINE  SOURCE
                =1 1755
                =1 1756
                =1 1757
                =1 1758
                =1 1759
                =1 1760  FILT 2:
09A2 D200       F =1 1761          SETB   RF PHASE
09A4 7900       F =1 1762          MOV    R1,#F2 BUF+3
09A6 750008     F =1 1763          MOV    F2 BIT,#8
09A9 750000     F =1 1764          MOV    F2 BUF,#0
09AC 750000     F =1 1765          MOV    F2 BUF+1,#0
09AF 750000     F =1 1766          MOV    F2 BUF+2,#0
09B2 750000     F =1 1767          MOV    F2 BUF+3,#0
                =1 1768
09B5 900000     F =1 1769          MOV    DPTR,#LCD RD INST
09B8 E0         =1 1770            MOVX   A,@DPTR
09B9 20E7FC     =1 1771            JB     ACC.7,$-1
                =1 1772
09BC 900000     F =1 1773          MOV    DPTR,#LCD WR INST
09BF 7404       =1 1774            MOV    A,#04H
09C1 F0         =1 1775            MOVX   @DPTR,A
                =1 1776
09C2 900000     F =1 1777          MOV    DPTR,#LCD RD INST
09C5 E0         =1 1778            MOVX   A,@DPTR
09C6 20E7FC     =1 1779            JB     ACC.7,$-1
                =1 1780
09C9 900000     F =1 1781          MOV    DPTR,#LCD WR INST
09CC 247E       =1 1782            ADD    A,#(80H-2)
09CE F0         =1 1783            MOVX   @DPTR,A
                =1 1784
09CF E500       F =1 1785          MOV    A,RF RAW BIT
09D1 B40810     =1 1786            CJNE   A,#8,F2 LOOP
                =1 1787
09D4 900000     F =1 1788          MOV    DPTR,#LCD RD INST
09D7 E0         =1 1789            MOVX   A,@DPTR
09D8 20E7FC     =1 1790            JB     ACC.7,$-1
                =1 1791
09DB 900000     F =1 1792          MOV    DPTR, #LCD RD DATA
09DE E0         =1 1793            MOVX   A,@DPTR
09DF F500       F =1 1794          MOV    RF CURR,A
09E1 750000     F =1 1795          MOV    RF RAW BIT,#0
                =1 1796  $EJ
                =1 1797  ;*********************************************
                =1 1798  F2 LOOP:
09E4 B296       =1 1799            CPL    P1.6
09E6 B296       =1 1800            CPL    P1.6
09E8 C500       F =1 1801          XCH    A,RF CURR
09EA 13         =1 1802            RRC    A
09EB C500       F =1 1803          XCH    A,RF CURR
09ED C0D0       =1 1804            PUSH   PSW
                =1 1805
09EF 0500       F =1 1806          INC    RF RAW BIT
09F1 E500       F =1 1807          MOV    A,RF RAW BIT
09F3 B40816     =1 1808            CJNE   A,#8,F2 MORE
                =1 1809
09F6 900000     F =1 1810          MOV    DPTR,#LCD RD INST
09F9 E0         =1 1811            MOVX   A,@DPTR
09FA 20E7FC     =1 1812            JB     ACC.7,$-1
                =1 1813
09FD 547F       =1 1814            ANL    A,#7FH
09FF 6427       =1 1815            XRL    A,#27H
0A01 602D       =1 1816            JZ     F2 PAD
                =1 1817
0A03 900000     F =1 1818          MOV    DPTR,#LCD RD DATA
0A06 E0         =1 1819            MOVX   A,@DPTR
0A07 F500       F =1 1820          MOV    RF CURR,A
0A09 750000     F =1 1821          MOV    RF RAW BIT,#0
                =1 1822  F2 MORE:
0A0C D0D0       =1 1823            POP    PSW
0A0E 4004       =1 1824            JC     F2 LONG
                =1 1825
0A10 B200       F =1 1826          CPL    RF PHASE
0A12 8006       =1 1827            SJMP   F2 TEST PHASE
                =1 1828  F2 LONG:
0A14 300003     F =1 1829          JNB    RF PHASE,F2 TEST PHASE
0A17 020000     F =1 1830          JMP    F2 ERROR
                =1 1831  F2 TEST PHASE:
0A1A 20000C     F =1 1832          JB     RF PHASE, F2 NEXT
0A1D A200       F =1 1833          MOV    C,RF LEVEL
0A1F C7         =1 1834            XCH    A,@R1
```

-continued

DATA FILTERING, CHECKING AND DECODING SUBROUTINES

```
LOC  OBJ                LINE  SOURCE
0A20 13          =1     1835          RRC   A
0A21 C7          =1     1836          XCH   A,@R1
0A22 D50004    F =1     1837          DJNZ  F2 BIT,F2 NEXT
                 =1     1838
0A25 19          =1     1839          DEC   R1
0A26 750008    F =1     1840          MOV   F2 BIT,#8
                 =1     1841  F2 NEXT
0A29 B200      F =1     1842          CPL   RF LEVEL
0A2B B900B6    F =1     1843          CJNE  R1, #F2 BUF-1,F2 LOOP
0A2E 8008        =1     1844          SJMP  F2 WRAP
                 =1     1845  F2 PAD:
0A30 D0E0        =1     1846          POP   ACC
0A32 E7          =1     1847          MOV   A,@R1
                 =1     1848  F2 PAD LOOP:
0A33 03          =1     1849          RR    A
0A34 D500FC      =1     1850          DJNZ  F2 BIT,F2 PAD LOOP
0A37 F7          =1     1851          MOV   @R1,A
                 =1     1852  F2 WRAP:
0A38 C3          =1     1853          CLR   C
                 =1     1854  F2 EXIT:
0A39 900000    F =1     1855          MOV   DPTR,#LCD RD INST
0A3C E0          =1     1856          MOVX  A,@DPTR
0A3D 20E7FC      =1     1857          JB    ACC.7,$-1
0A40 900000    F =1     1858          MOV   DPTR, #LCD WR INST
0A43 7406        =1     1859          MOV   A,#06H
0A45 F0          =1     1860          MOVX  @DPTR,A
0A46 22          =1     1861          RET
                 =1     1862  F2 ERROR:
0A47 D3          =1     1863          SETB  C
0A48 80EF        =1     1864          SJMP  F2 EXIT
                        1865          END
```

What is claimed is:

1. A security system comprising:

sensing means for sensing a condition;

transmitter means responsive to said sensing means for transmitting a digital signal representative of said condition;

receiving means for receiving said digital signal;

sampling means for sampling said received digital signal a plurality of times during each digital data bit and for producing a plurality of data samples for each received data bit;

means for storing a value related to an average of said data samples;

averaging means communicating with said means for storing for averaging said plurality of data samples together with a value related to a previous set of data samples to produce an averaged data signal with hysteresis; and output means responsive to said averaged data signal for producing an output indicative of said condition.

2. A security system as in claim 1 wherein said output means includes a checking means for checking said data signal for conformance to a predetermined arrangement.

3. A security system as in claim 2 wherein said transmitter means includes a means for Manchester encoding said digital signal and said checking means comprises a means for checking that the data signal conforms to the transition timing requirements for Manchester encoded signals.

4. A security system as in claim 2 wherein said transmitter means includes a means for adding a cyclic redundancy code to said transmitted digital signal and said checking means comprises a means for generating a cyclic redundancy code and for comparing said generated cyclic redundancy cyclic redundancy code and for comparing said generated cyclic redundancy code to the cyclic redundancy code of said received signal.

5. A security system as in claim 2 wherein said transmitter means includes a means for transmitting a transmitter identifier signal and said checking means includes a means for storing an identifier signal and a means for checking that said received signal includes an identifier signal that matches said stored identifier signal.

6. A security system as in claim 1 wherein said averaging means comprises:

means for calculating a moving average of said data samples; and means for differentiating said average into a high or a low signal depending on said value related to a previous set of data samples.

7. A security system as in claim 1 wherein said output means comprises means for determining a value representative of the length of time between transitions in said averaged data signal.

8. A security system as in claim 7 wherein said output means further comprises means for determining the phase of the transitions in said averaged data signal.

9. A security system as in claim 8 wherein said transmitter means includes a means for Manchester encoding said digital signal and said output means further includes a means for checking that said time values are within the limits required by Manchester encoding and that said phase of said transitions conforms to the proper phase for Manchester encoded signal transitions.

10. A method of providing an indication of a condition at a location in a security area comprising the steps of:

sensing said condition and providing a data signal representative of the condition;

transmitting said data signal;

receiving said data signal;

sampling said received data signal a plurality of times during each data bit, averaging said data samples together with a value related to a previous set of data samples to produce an averaged data value with hysteresis;

storing a value related to said averaged data value for use in calculation of the next average; and utilizing said averaged data to provide an indication of said condition.

11. The method of claim 10 wherein said step of utilizing said averaged data includes the step of checking the data for conformance to a predetermined, arrangement.

12. The method of claim 11 wherein said step of transmitting comprises transmitting a Manchester encoded signal, and said step of checking comprises checking that the averaged data conforms to the transition timing requirements for Manchester encoded signals.

13. The method of claim 12 wherein said step of utilizing further comprises the step of determining the length of time between transitions in said averaged data signal and the phase of said transitions, and wherein said step of checking comprises checking that said length of time is within the limits required for Manchester encoded signals and that the phase of said transitions conforms to the proper phasing for Manchester encoded signals.

14. The method of claim 10 wherein said step of averaging comprises:

calculating a moving average of said data samples; and differentiating said average into a high or low value depending on said value related to a previous set of data samples.

* * * * *